US006267113B1

(12) United States Patent
Maust et al.

(10) Patent No.: US 6,267,113 B1
(45) Date of Patent: Jul. 31, 2001

(54) FREE STANDING FIREPLACE HEARTH

(75) Inventors: Daniel A. Maust, Winfield; John Howard, Northwoods; Robert W. Machacek, Lombard, all of IL (US); John Desautels, Bothel, WA (US); T. C. Mathew, Louisville, KY (US); Paul Hoffman, Chicago, IL (US)

(73) Assignee: Fire Design LLC, Shelbyville, KY (US)

( * ) Notice: Subject to any disclaimer, the term of this patent is extended or adjusted under 35 U.S.C. 154(b) by 0 days.

(21) Appl. No.: 09/534,780

(22) Filed: Mar. 24, 2000

Related U.S. Application Data

(60) Provisional application No. 60/126,073, filed on Mar. 25, 1999.

(51) Int. Cl.[7] ..... F24C 15/00
(52) U.S. Cl. ..... 126/512; 431/125
(58) Field of Search ..... 126/92 AC, 92 R, 126/500, 504, 519, 512; 431/125

(56) References Cited

U.S. PATENT DOCUMENTS 4,060,068 * 11/1977 Lever et al. ..... 126/500
4,362,146 * 12/1982 Schuller ..... 126/504
5,016,613 * 5/1991 Maitland ..... 126/500
5,026,271 * 6/1991 Orlov et al. ..... 431/125
5,794,610 * 8/1998 Facchina ..... 431/125

* cited by examiner

*Primary Examiner*—Sara Clarke
(74) *Attorney, Agent, or Firm*—Wood, Herron & Evans LLP

(57) ABSTRACT

A freestanding fireplace hearth includes an artificial log set, a snuffer and a fuel tray beneath the snuffer and log set. When refilling is necessary, a drawer containing the fuel tray is pulled out for access, the tray descending away from the snuffer as it is pulled laterally outward. After filling, the drawer is pushed in and the fuel tray moves laterally under, and then upwardly into operative position with respect to, the snuffer. The snuffer can be opened to allow vaporized fuel to ascend into the log set. When lit, an attractive dancing flame is displayed. When the snuffer is closed, fuel vapor flow through the log set closes and the fire is extinguished. Details of tray, drawer, snuffer and hearth construction are disclosed.

19 Claims, 13 Drawing Sheets

FREE STANDING FIREPLACE HEARTH

We claim the benefit of and priority to U.S. Provisional Application Ser. No. 60/126,073 filed Mar. 25, 1999 entitled FREE STANDING FIREPLACE HEARTH.

BACKGROUND OF THE INVENTION

This invention relates to a free standing fireplace hearth and a fuel composition for use therein.

In many patio, deck, back yard or other similar outside settings, an actively burning fire is often used to add significant ambiance to the setting. In addition to the visual appearance of the fire, the setting is enhanced by the soothing and pleasing crackling and popping sound of a wood burning fire. However, wood burning fires of this type often require significant attention to periodically add logs to maintain the fire. Wood burning fires generate a significant amount of ash, soot and the like thereby requiring clean up. Further, open kettles or the like which are commonly used to house the burning logs present a significant hazard and often do not adequately contain the fire during use thereby leading to the potential and dangerous spread of the fire through falling and burning logs, cinders or the like. Constant attention to the fire is thereby prudently required.

Therefore, there is a need for an improved outdoor fireplace or hearth which avoids these above-described drawbacks while still offering the visual and audible ambiance of a burning wood fire.

In a further aspect of the invention, it is highly desirable to provide a self-containing fire hearth which provides the ambience of a wood burning fire, that is a flame which has the appearance and sound of a wood burning flame, but without the necessity of wood fuel or cleanup of waste combustion products usually attendant a wood-fueled fire. Moreover and in this regard, it will be appreciated that an "ambience" fire or flame need not be measured by the typical parameters applied to a fire. For example, heat output, or BTUs, is a typical fire or heat performance criteria as is the heat producing efficiency from the fuel used. In a free-standing fire or hearth for ambience purposes, these parameters and efficiencies are relatively unimportant. In the case of heat production, the less heat produced, the better.

What is important are entirely different characteristics, namely burn time, fuel volume and burn characteristics. Thus, the efficiency of a decorative or ambient fire, for example, is measured in consideration of these parameters and their coalescence to provide the most desirable aesthetic result, with an acceptable burn time, at the least operational cost.

For example, acceptable burn characteristics require a fire with golden colored flame having random dancing patterns. A desirable burn time per fuel load is in the two to four hour range and the fuel cost per unit used should be low, compared to other systems within the above parameters.

Accordingly, it is a further objective of the invention to provide a freestanding fireplace hearth with an improved efficiency taking into account burn characteristics, volume of fuel used and burn time or duration per fuel unit consumed.

A further objective of the invention has thus been to provide a freestanding fireplace hearth with improved flame color and burning sound like a wood burning fire, at acceptable burn time and fuel volume used.

SUMMARY OF THE INVENTION

This invention overcomes the above-described and other drawbacks of known fireplace or hearth systems while still offering a visually and audibly pleasing safe live fire and associated ambiance in an outdoor setting.

In a presently preferred embodiment, the invention includes a free standing fireplace hearth for burning a fuel to provide an attractive ambiance fire in an outdoor setting. The fireplace hearth includes a base having a fuel tray defining a chamber slidably mounted therein on a drawer-like structure for movement between open and closed configurations and a spring biased latch to releasably secure the tray in the closed configuration. The tray is configured with a throat as an integral part of the overall combustion system as will be described. A snuffer or burner is disposed in the hearth over the tray and provides flaps or dampers for controlling the flame height and for snuffing out the flame as desired. The tray is mounted for movement on the drawer structure between a lowered and a raised position. A plurality of cams are pivotally oriented with respect to the tray. A stop is mounted on the base relative to the tray so that as the tray approaches the closed configuration, the tray abuts against the stop. Continued movement of drawer rails on which the tray is mounted toward the closed configuration activates the cams and thereby elevates the tray relative to the snuffer into the raised position and in operative contact with the snuffer.

A log set of fiber/ceramic or other wood simulation material is operably disposed over the snuffer. Flame from the snuffer dances up through passages in the log set which has features which glow. Air moving up the passages produces lift to enhance the burn characteristics of the flames.

A pair of spaced dampers or shutters are mounted for movement to and between a closed snuffing configuration and a fully open burn configuration. Each of the damper shutters are coupled via a linkage to a rotational control knob such that rotation of the control knob in a first direction pivots the damper shutters toward the closed snuffing configuration to extinguish the burning fuel. Rotation of the control knob in a second opposite direction pivots the damper shutters toward the fully open configuration to increase the flame height through the log set.

A plurality of posts extend upwardly from the base to support a roof. The roof includes a heat shield mounted on the interior thereof to deflect hot air generated by the burning fuel from impinging upon the roof and thereby maintains the roof at a lower temperature than the heat shield during fuel burning. At least a portion of the heat shield is spaced from the roof to define space for an insulation layer of air between the heat shield and the cover. A plurality of baffles are included on the heat shield to direct the heat out from under the roof, off of the heat shield and cooler air into the insulation layer of air between the roof and the heat shield.

The present invention in another aspect includes a specific composition of fuel which is suitable for use in the free standing fireplace hearth. The fuel in a presently preferred embodiment is a gel composition which satisfies the characteristics of fireplace fuel with respect to aesthetic features such as producing golden high luminous flame without producing an offensive odor or smoke while still generating a crackle and pop sound. Further, the fuel is safe for handling and storage purposes and the formulation is of generally non-toxic components as well as being self-contained if spilled, environmentally safe in burning, producing minimal pollutants and being readily extinguishable without any smoke buildup. Further, the burnt fuel does not produce any significant amount of residue or the like.

Accordingly, it will be appreciated that the fuel tray, the fuel chamber throat in the tray, the snuffer with its dampers and the log set combine to define a combustion system producing a flame having the random pattern appearance of a wood flame with desirable burn time and low fuel volume requirements.

In brief, the combustion system performs or acts something like a carbueration system.

When the drawer is shut the fuel chamber mates or couples with the snuffer assembly to complete the combustion system and also acts as a way to extinguish the flame. Air is mixed with the fuel. The fuel vaporizes in the fuel chamber and the air-alcohol gas mixture rises or moves through the throat out of the chamber via a plurality of flame paths created by a wedge-shaped, diverter of the snuffer and the openings on top of the snuffer assembly. The damper or doors control the height of the flames and also act when closed to snuff out the flame. The log set is decorative. As the flames move through the log set, they actually warm the log set material causing it to glow when touched by flame. The flames move through the log set with as little impingement as possible so that sooting is kept to a minimum. The passages in the log set warm up and cause convection of additional ambient air up through the passages so the fire or flame is decoupled and is lifted up therethrough. The system is self-regulating, so as the user adjusts the dampers, increasing or decreasing the size of the flame, the combustion system continues to work the same way.

A preferred fuel according to the invention is a gel composition, or mix of a lower alkyl alcohol, water, flammable organic tertiary butyl alcohol and double or single walled microencapsulated solvents, gelling agent, polyacrylic acid, cross linking agent and surfactant. Such a fuel as described herein, when used in the hearth described herein, produces desirable burn characteristics over an acceptable burn time and with an acceptable fuel volume required.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
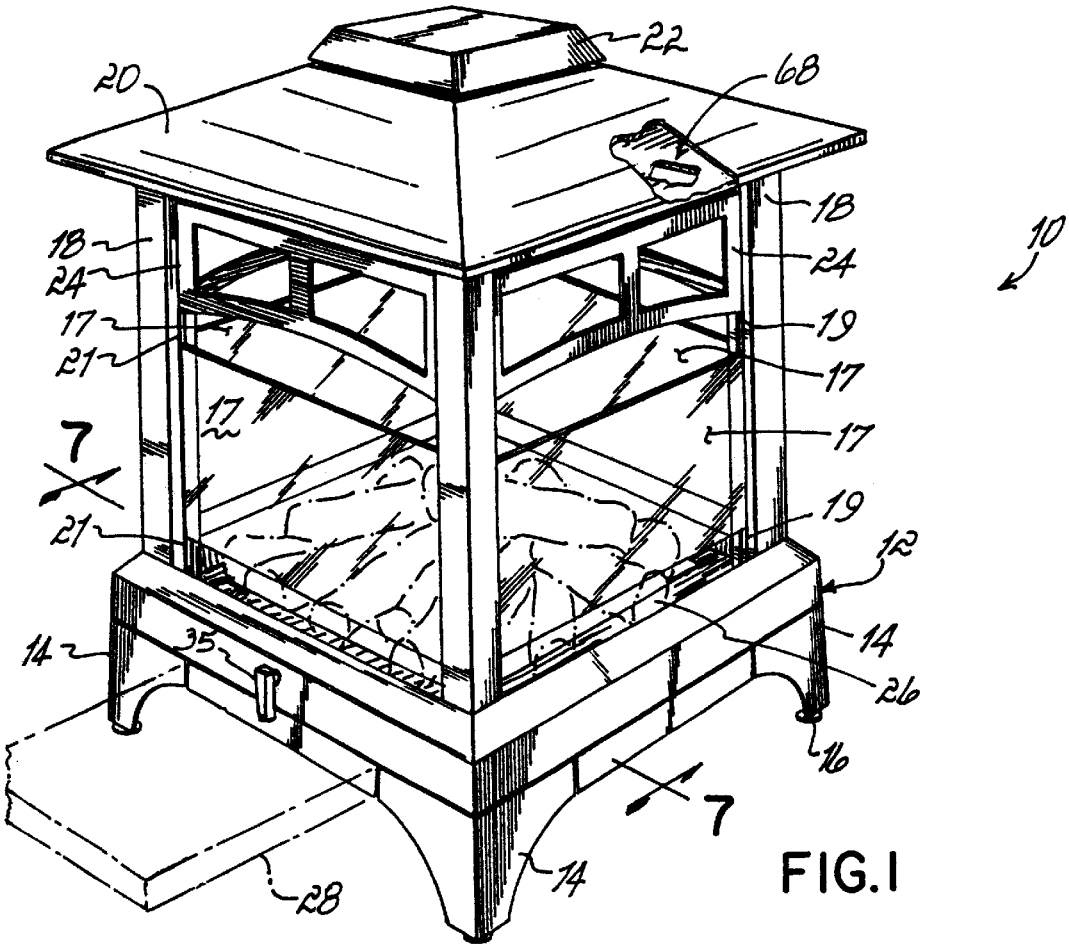
FIG. 1 is a perspective view of the invention showing in phantom a withdrawn fuel tray for fueling.
Figure 2:
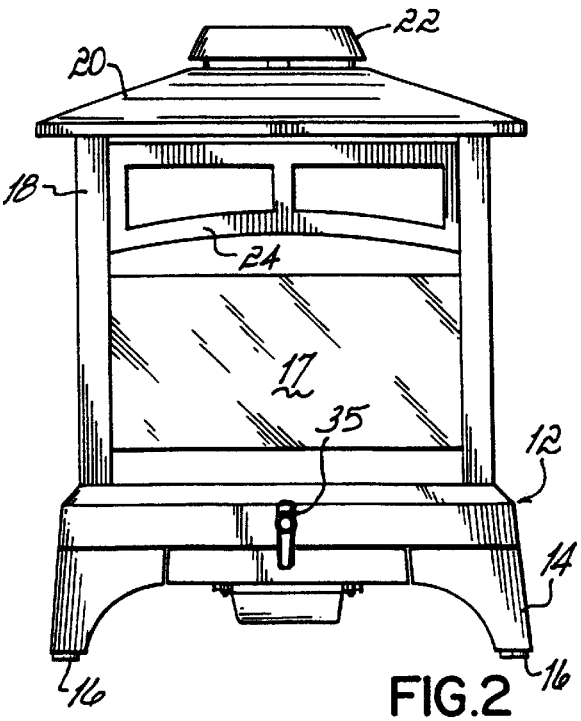
FIG. 2 is a front elevational view of the invention of FIG. 1.
Figure 3:
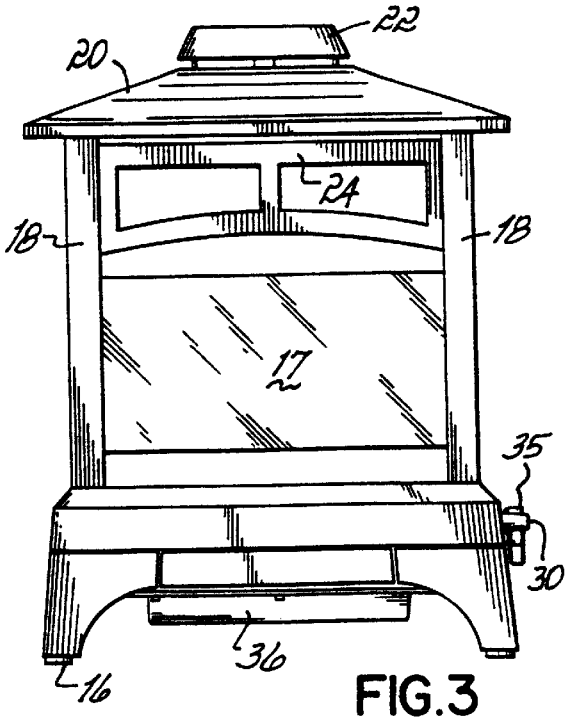
FIG. 3 is a side elevational view of the invention of FIG. 1.
Figure 4:
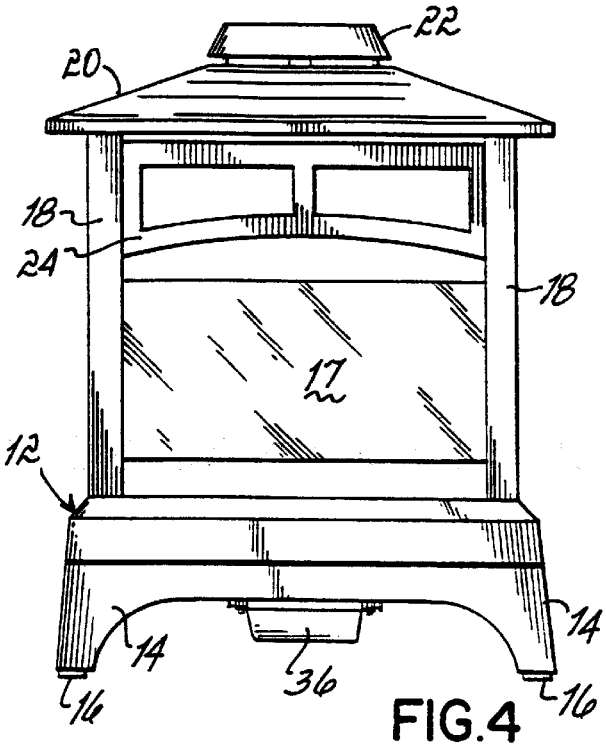
FIG. 4 is a rear elevational view of the invention of FIG. 1.
Figure 5:
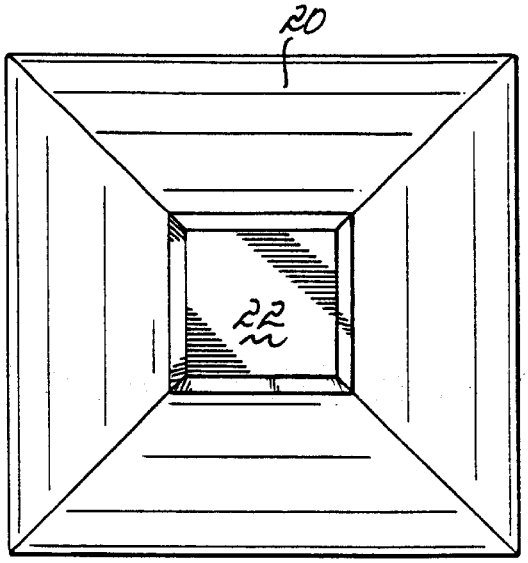
FIG. 5 is a plan view of the invention of FIG. 1.
Figure 6:
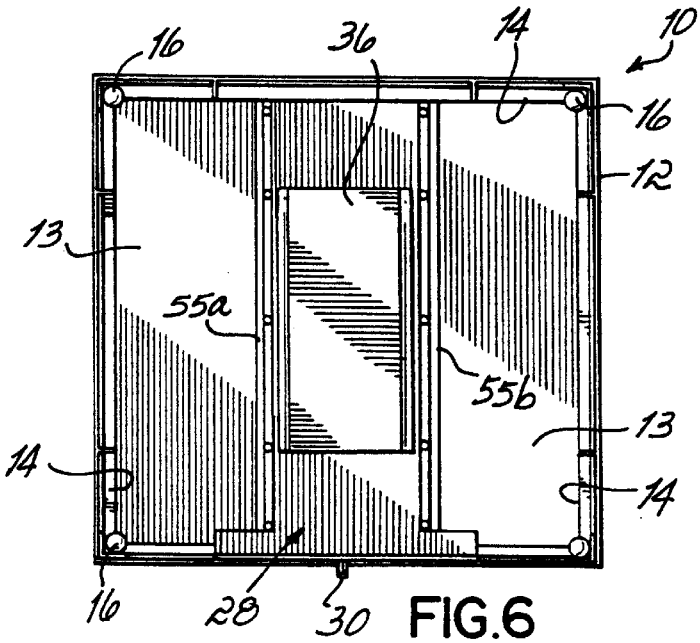
FIG. 6 is a bottom view of the invention of FIG. 1.

Referring to the figures, presently preferred embodiments of a free standing fireplace hearth 10 according to this invention are shown. The hearth 10 is intended for outdoor use and is free standing and portable as needed.

The hearth 10 includes a base 12 with four downwardly projecting legs 14, each of which include a rotationally adjustable foot 16, all of which in combination could be used to level the base 12 and the hearth 10 as appropriate. An upwardly extending post or column 18 is mounted proximate each corner of the base 12 and the posts 18 in combination support a roof 20. The roof 20 includes a centrally located vent cap 22 secured to and spaced from the roof 20 to provide for the free flow of air therebetween. A support arch 24 is mounted between each pair of adjacent posts 18. A plurality of preferably artificial, although realistic appearing, logs making up log set 26 (FIGS. 13, 14) are positioned atop the base 12 within the hearth 10. Log set 26 includes side logs 27, 29 and a center log 31, for example.

Figure 12:
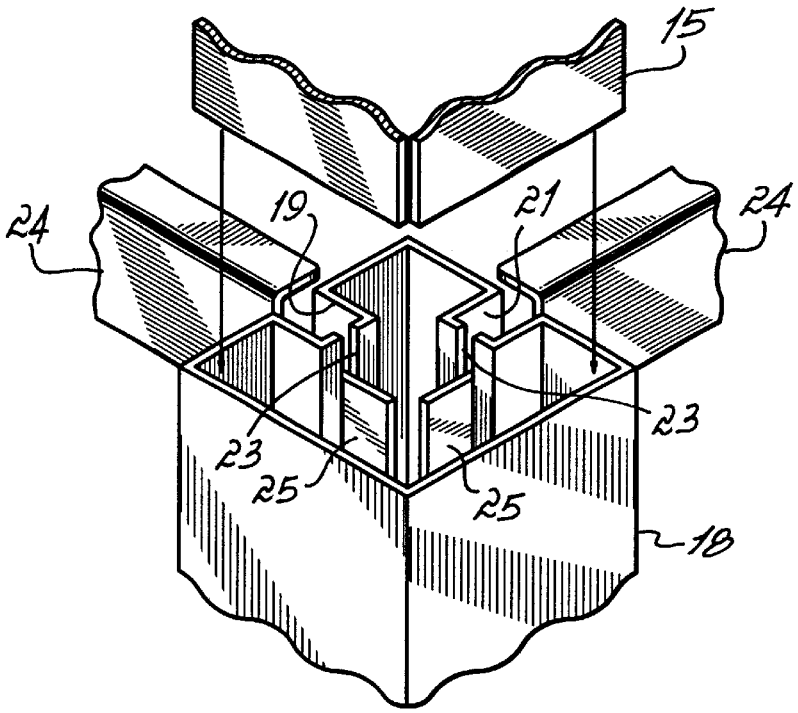
FIG. 12 is a perspective view of a corner structure of the invention as shown in FIG. 1.

It will be appreciated that posts 18 are preferably formed, hollow columns having in two adjacent sides slots 19 and 21 (FIG. 12). Also, each slot is provided with a groove 23 in a bottom of the slot and extending a short distance downwardly.

On assembly, the corner posts 18 are secured in appropriate recesses in base 12. A resilient tube, gasket or bumper is inserted into a lower end of slot 19, 21 to resiliently support a preferably transparent panel 17, such as glass or plastic slid downwardly to the bumper in the slots so the bottom edge of panels 17 are spaced from base 12. Thereafter, a tenon end 25 of a support arch 24 is slid into grooves 23 to lock the arches 24 in place and columns 18 together, the bottom of grooves 23 supporting the arches 24 above the glass panels 17 in slots 19, 21.

Figure 11:
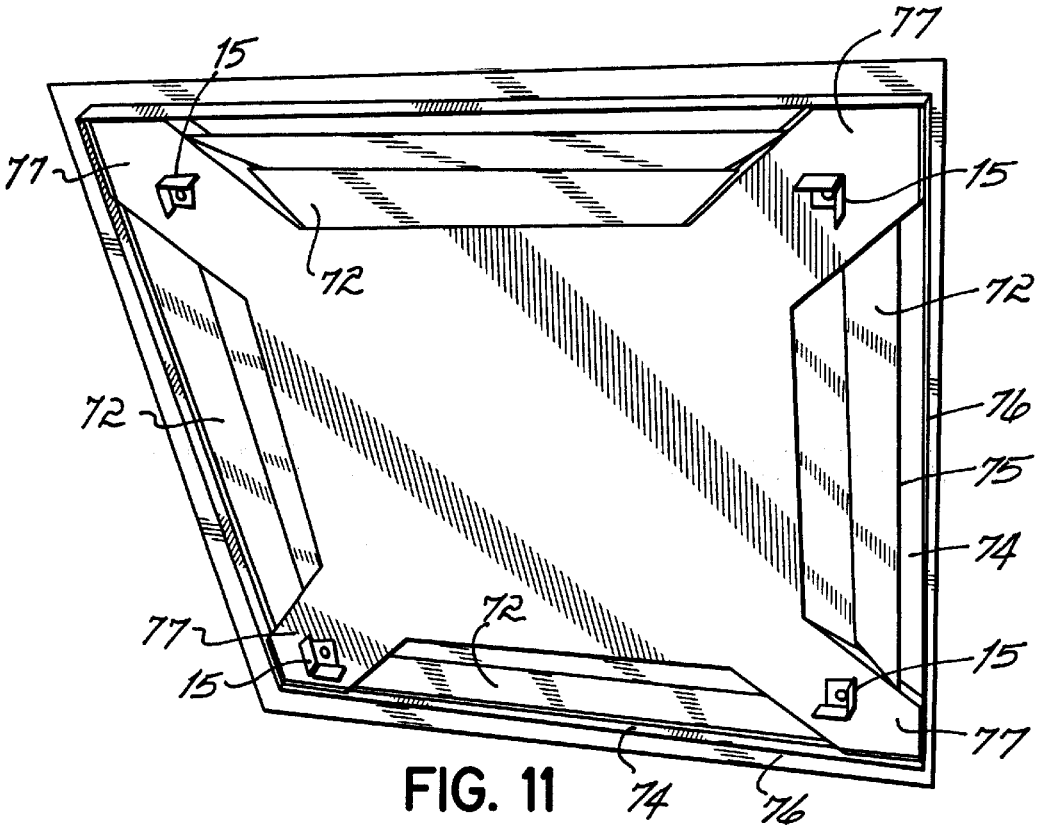
FIG. 11 is a perspective view of the roof and heat shield of FIGS. 1–7.

The roof 20 is provided with corner projections 15 (FIGS. 11, 12) which then fit into the top ends of corner columns 18 for securing the roof 20 and heat shield 68 thereon.

It will be appreciated that hearth 10 includes a floor 13 extending across the base 12 and alongside snuffer 42. Floor 13 may comprise two formed components of aluminum, metal, ceramic or other suitable material on each side of snuffer 42. One suitable, but not necessary material for the floor is a material manufactured by The Foundry in Toronto, Canada, under the name "Cool Crete".

Figure 8:
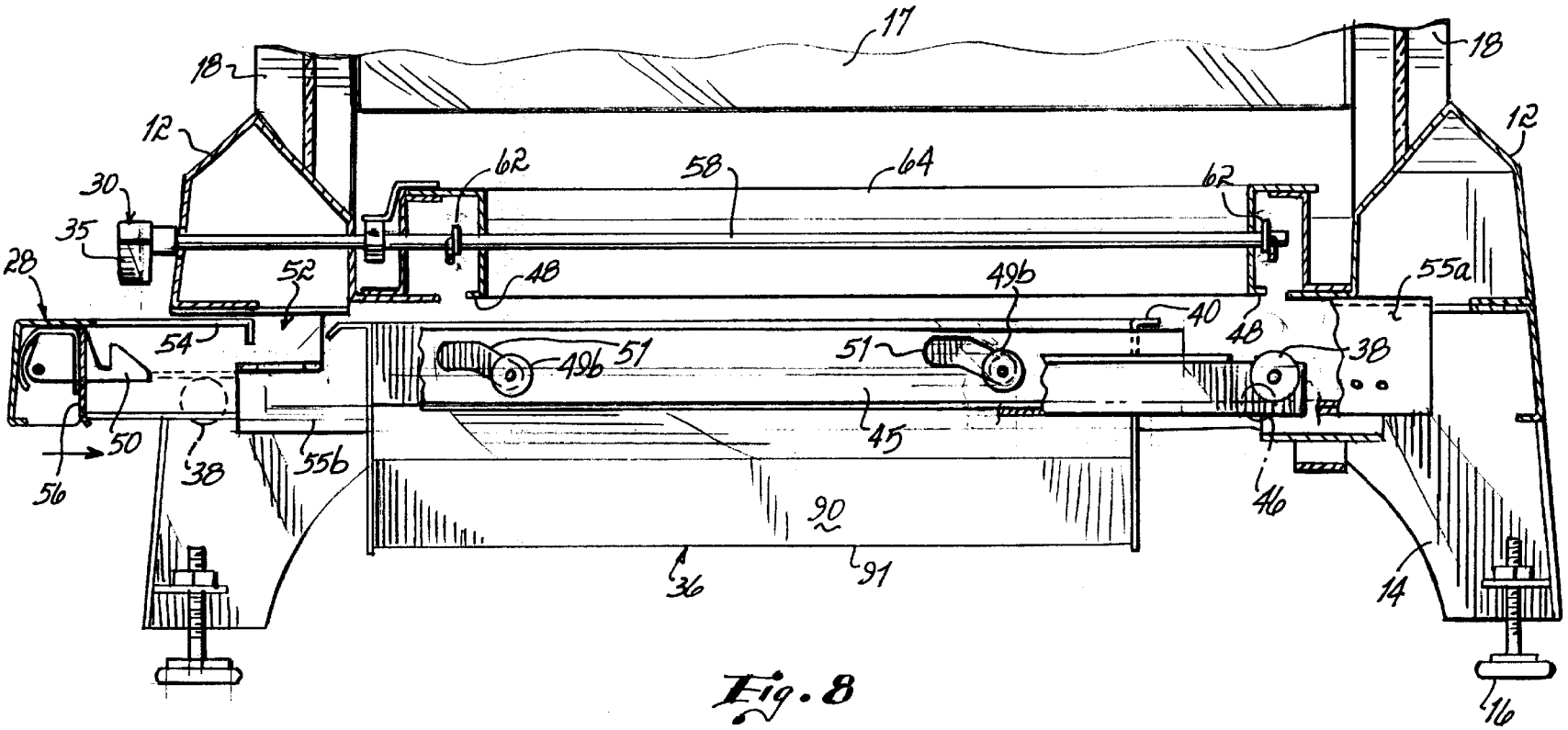
FIG. 8 is a cross sectional view taken along lines 8—8 of FIG. 7 with certain components removed for clarity.

A drawer structure 28 is slidably mounted in the base 12 for movement to and between a closed configuration (FIG. 9) and toward an open configuration (FIG. 8). The drawer structure 28 is slidably mounted on rollers 38. Rear rollers 38 are mounted on drawer rails 44, 45 and forward rollers 38 (FIG. 10B) on stationary slide rails 55*a* and 55*b*.

A control knob 30 projects from the base 12 for adjusting dampers 32, 33 to control flames resulting from burning fuel 34. Mounted within the drawer 28 is a fuel tray 36 defining a fuel chamber 37 for holding the vaporizing fuel 34. Tray 36 also defines a constricted throat 39 tapering inwardly over chamber 37.

Figure 7:
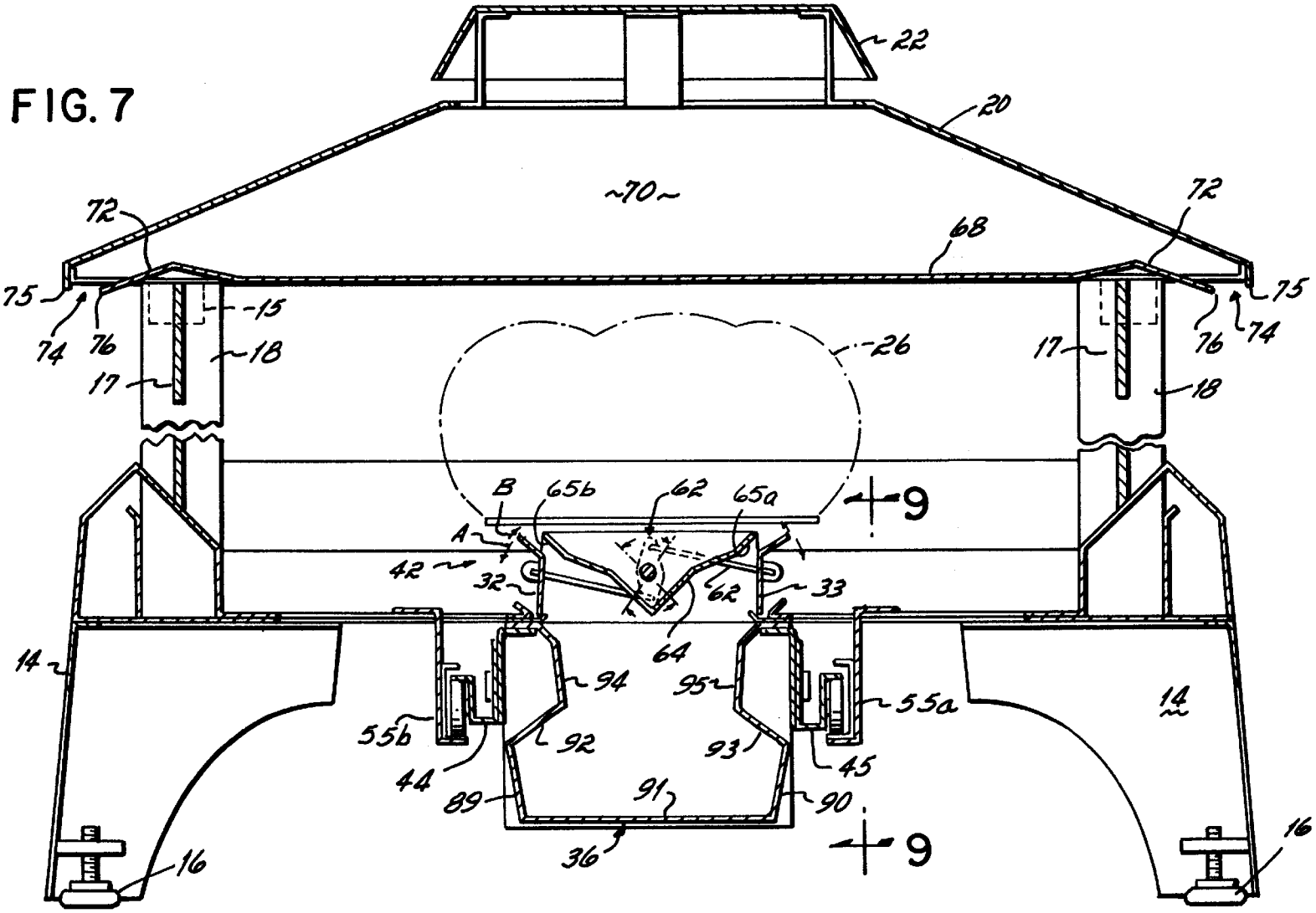
FIG. 7 is a cross-sectional view taken along lines 7—7 of FIG. 1 showing the fuel tray in closed, operational position.
Figure 9:
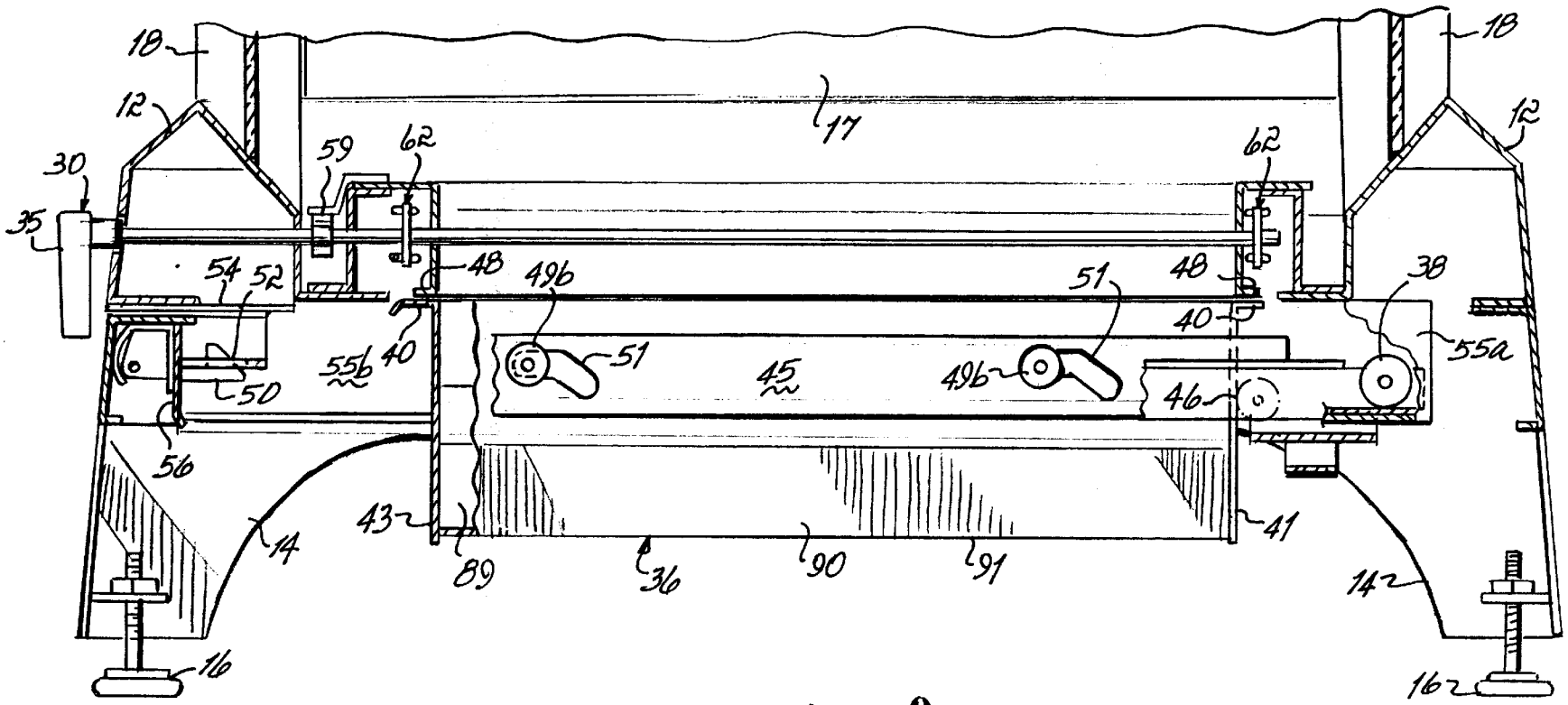
FIG. 9 is a cross sectional view taken along lines 9—9 of FIG. 7A with certain components removed for clarity.
Figure 10:
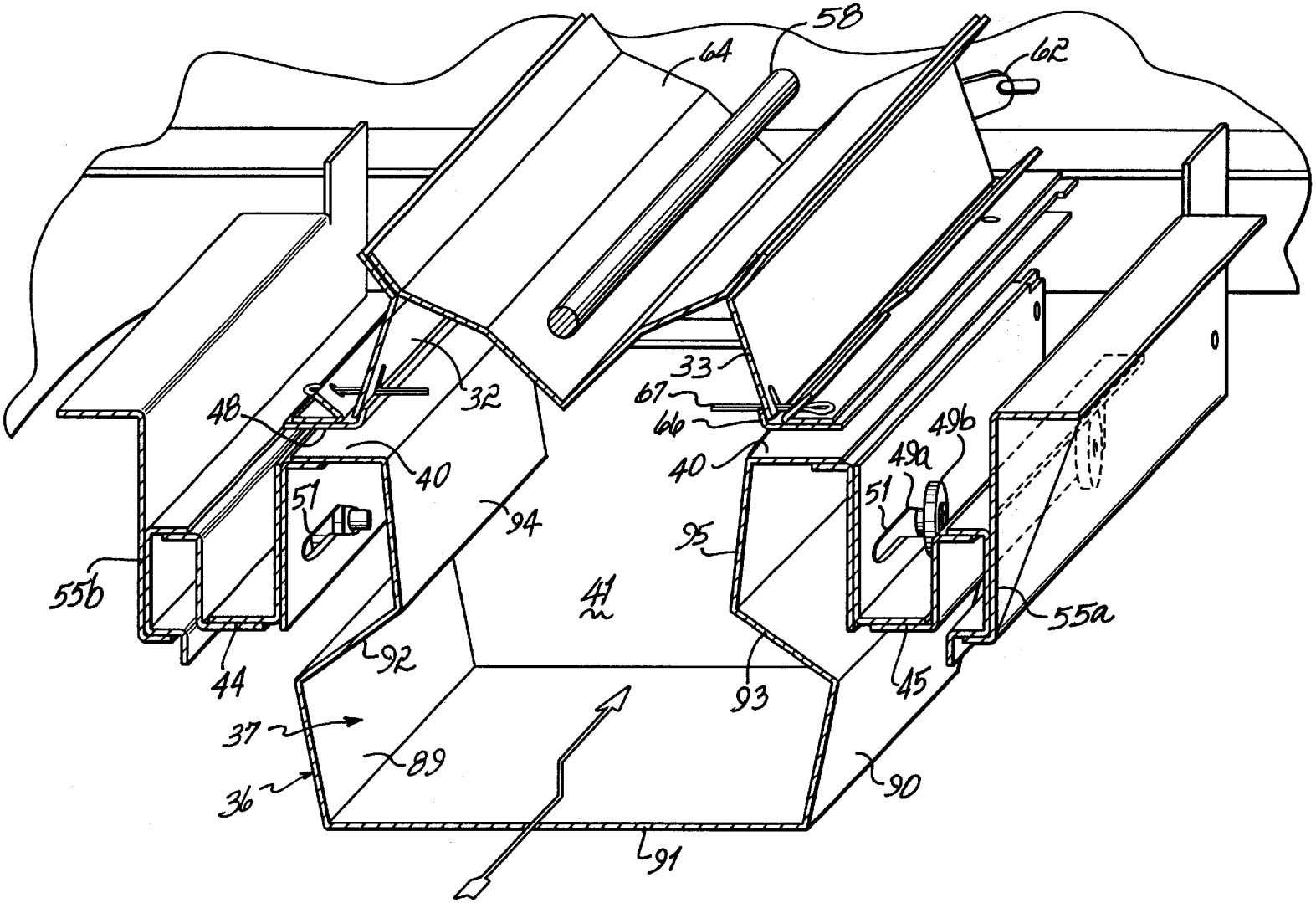
FIG. 10 is a perspective view showing the tray, drawer components and snuffer of FIGS. 1, 7A and 9.
Figure 10A:
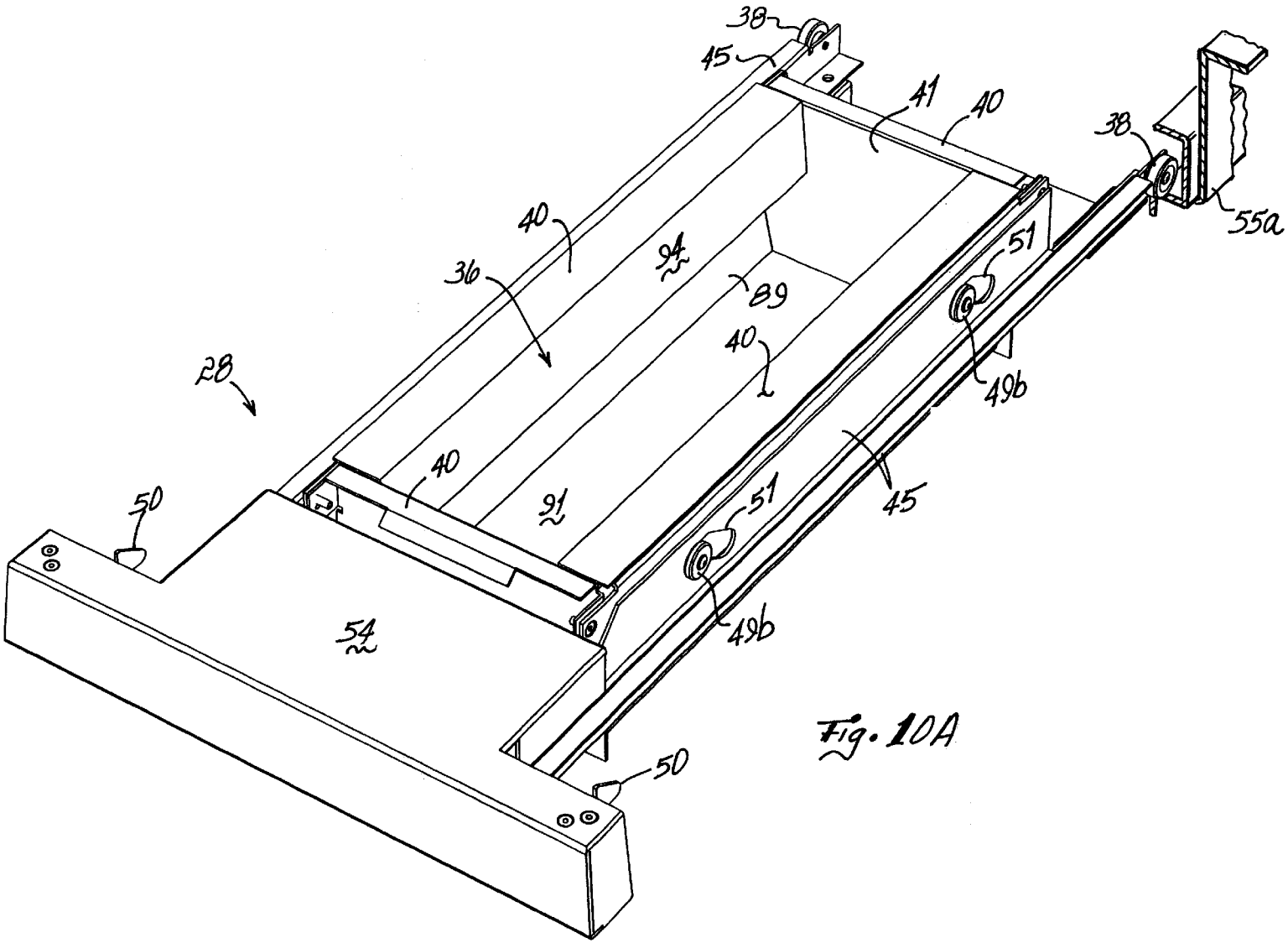
FIG. 10A is a perspective view of the upperside of the fuel tray and drawer of the invention.
Figure 10B:
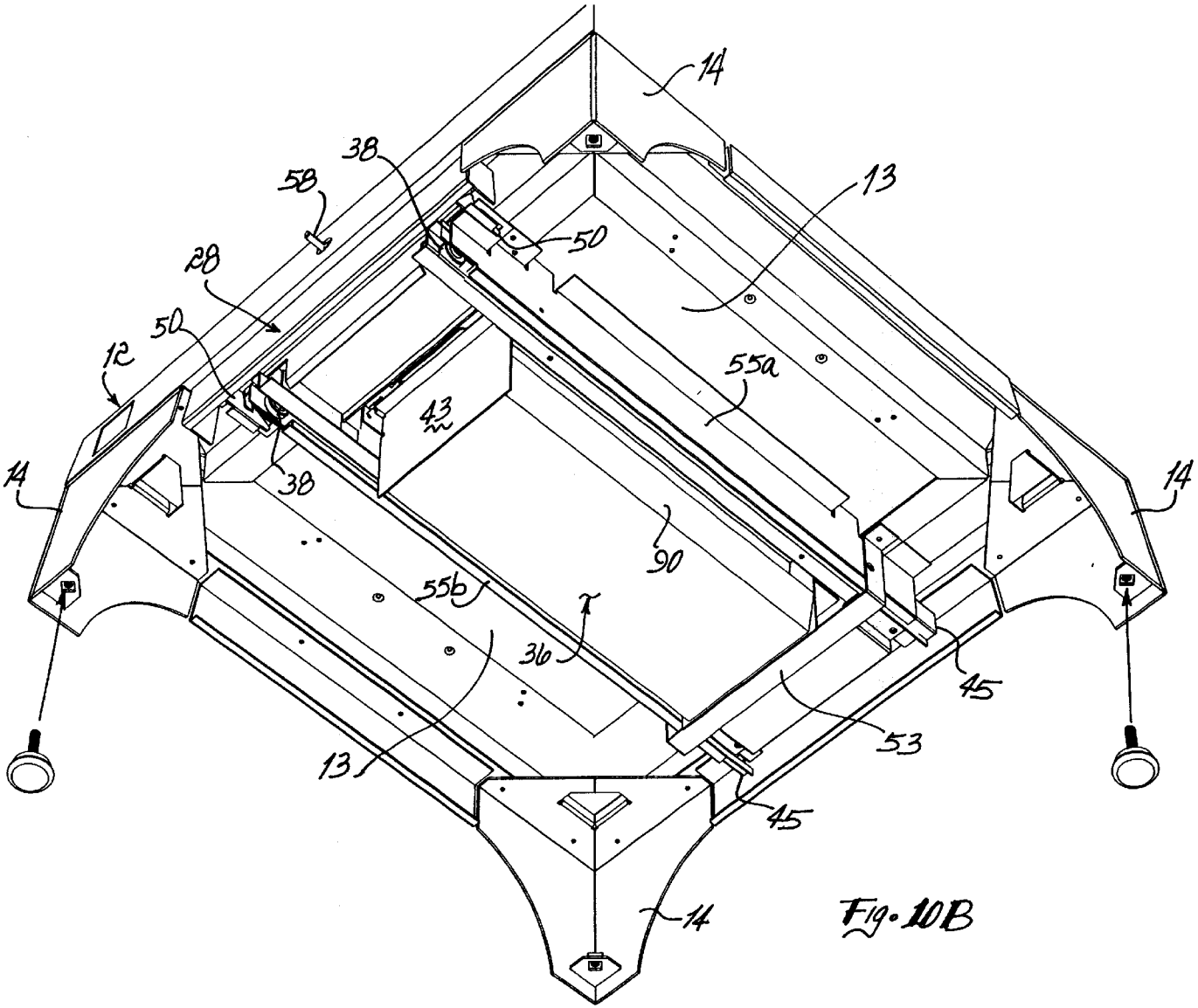
FIG. 10B is a perspective view of the underside of the hearth showing fuel tray and drawer components of the invention.
Figure 10C:
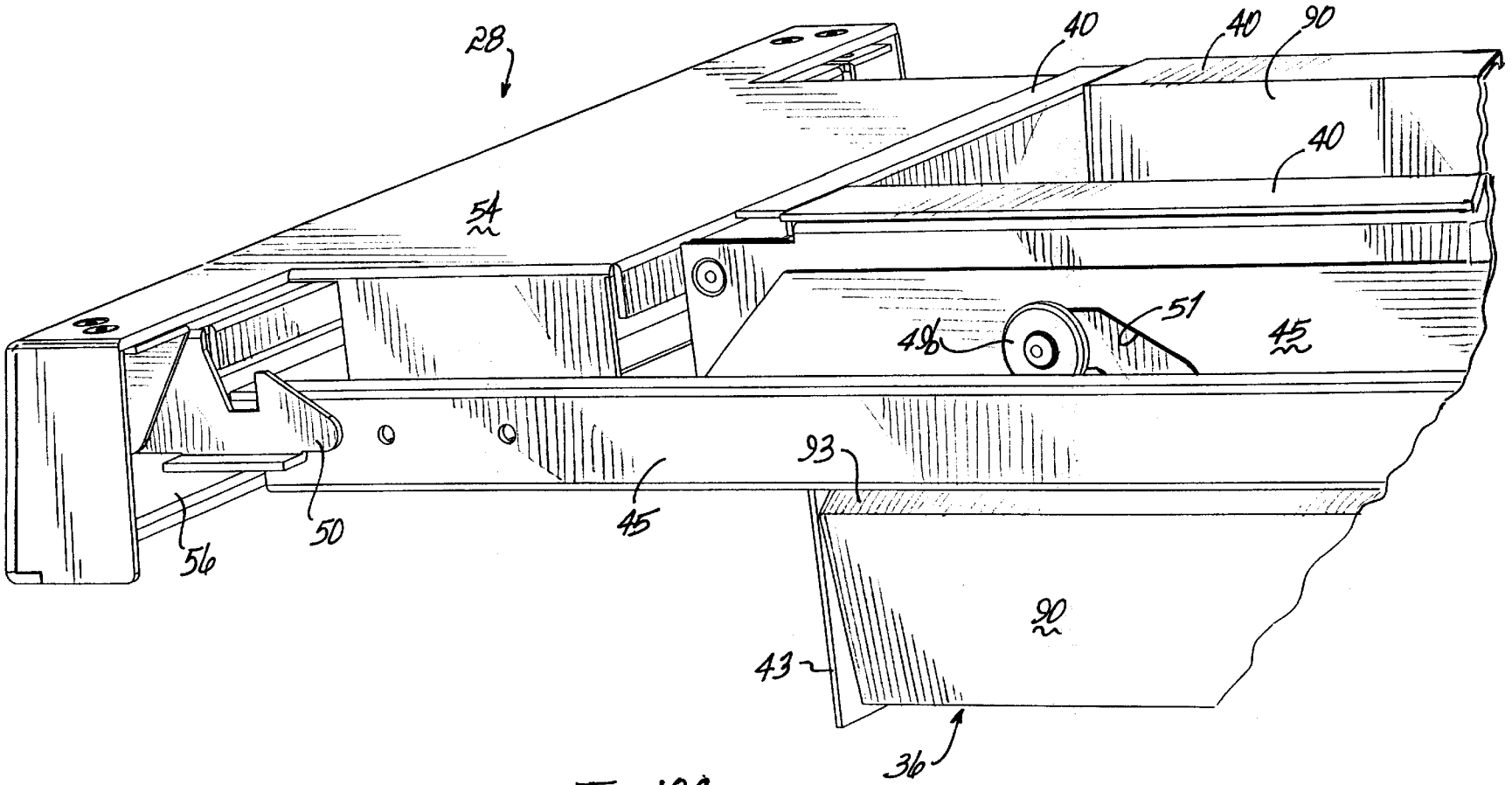
FIG. 10C is a perspective view of the forward end of the fuel tray and drawer of the invention viewed from a rear perspective.

The tray 36 has a rear end 41 and forward end 43 and is movably mounted on the drawer structure 28 for movement to and between a lowered position (FIG. 7A) when the drawer is moved toward an open configuration (FIGS. 7A and 8) and a raised or closed position (FIGS. 7 and 9). In the raised position, spaced uppermost flanges or lips 40 of the tray 36 are placed into operative sealing engagement with lower flanges or lips 48 (FIG. 7) of a snuffer 42 mounted within the base 12. The tray 36 in the raised sealing configuration inhibits air from entering between the lips 40 and flanges 48 during operation of the hearth 10 and allows extinguishment of the fire when desired by operation of the snuffer dampers 32, 33.

Figure 7A:
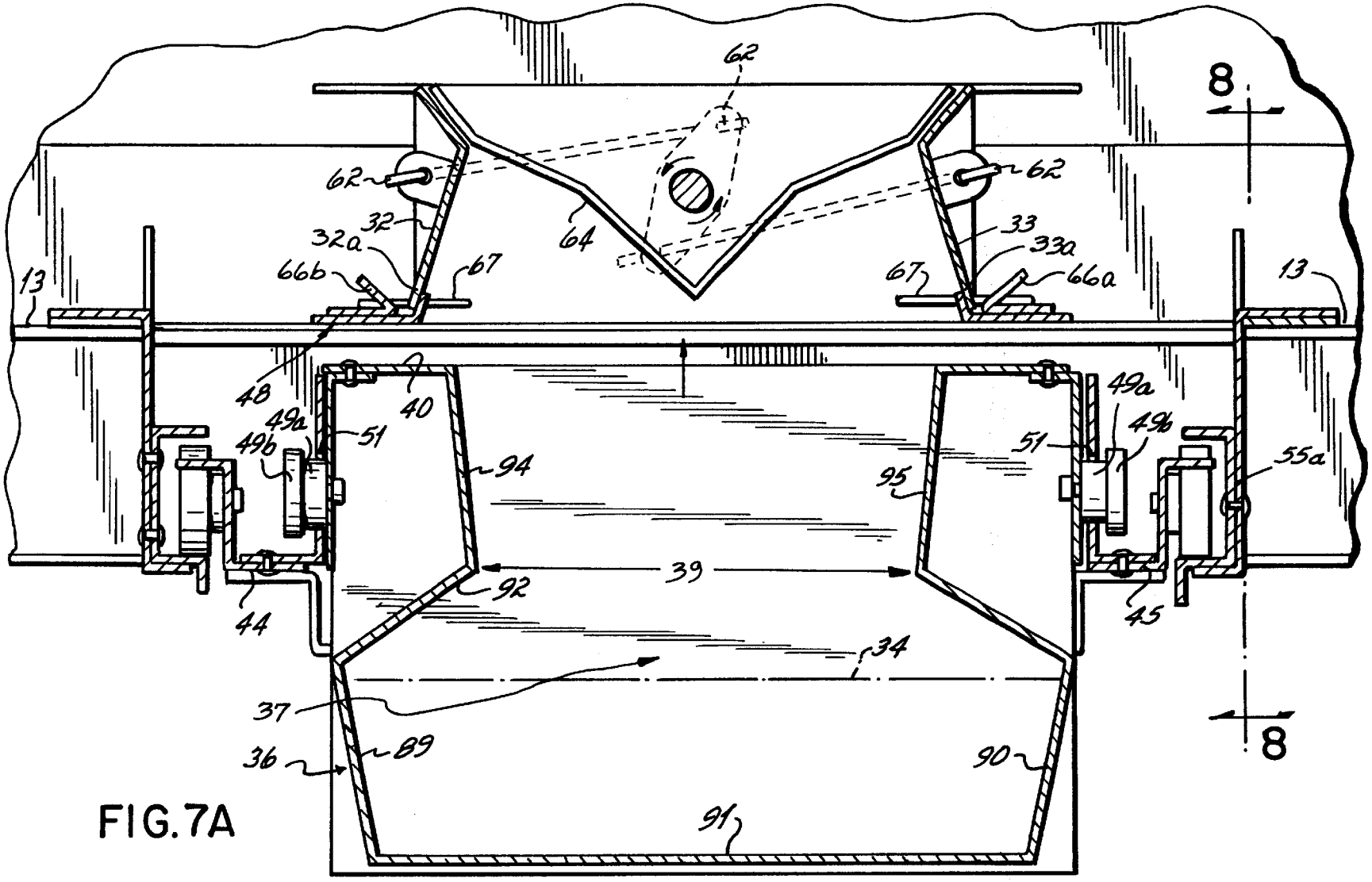
FIG. 7A is a view of the fuel tray and its drawer mount similar to FIG. 7, but showing only the tray, drawer components and snuffer in lowered partially opened position.

The tray 36 is operatively coupled to the slidable drawer 28 by way of a cam mechanism comprising, for example, cam followers 49 mounted on tray 36 and cam slots S1 (FIGS. 8, 9) disposed in slidable drawer rails 44, 45 (FIG. 7A). As shown, cam followers 49 comprise a cam follower portion 49*a* and an enlarged flange 49*b* outwardly thereof (with respect to tray 36) to maintain the cam followers in the slots 51 in the rails 44, 45.

When the drawer 28 is pushed inwardly or rearwardly, the back end of the tray 36 engages a stop 46. Continued rearward movement, however, of rails 44, 45 pushes the cam slots 51 under or across the followers 49, raising them, and thus tray 36, upwardly toward snuffer 42, where lips 40, 48 engage effectively to cut off air passages therebetween.

In an alternative embodiment (not shown) the tray 36 is coupled to the drawer 28 by a plurality of links which are pivotally coupled at a first lower end to the tray and at a second upper end to the drawer 28. As the drawer slides or rolls from the open configuration toward the closed configuration, a back end of the tray 36 approaches a stop 46 (see FIG. 9) mounted on the base 12 so that as the drawer approaches the closed configuration, the tray abuts against the stop. Continued movement of the drawer 28 toward the closed configuration thereby pivots the links toward a more vertical orientation. Since the tray is prevented from translating in a generally horizontal direction, it rises vertically on the links into sealing engagement with the snuffer through the continued lateral movement of the drawer inwardly or rearwardly towards the closed configuration.

Once the drawer 28 is in the closed configuration and the tray 36 is in the raised position, the drawer 28 is maintained in the closed configuration by a spring biased latch 50 which engages holes 52 in a keeper plate 54 of the stationary slide rails 55*a*, 55*b*. To open the drawer, a user grasps a catch or arm 56 on the latch 50 to thereby pivot the latch out of engagement with the keeper plate 54 and permit the drawer 28 to be pulled open and the tray 36 lowered as the cam followers 49 descend in slots 51 when drawer 28 is pulled out so the tray is at least partially exposed for filling.

As shown in the figures and particularly FIGS. 8 and 9, the control knob 30 is mounted on a shaft 58 for pivotal movement to adjust the position of spaced dampers 32, 33 of the snuffer 42. These are mounted for movement to and between a closed snuffing configuration and a fully open configuration (dotted line in FIG. 13), with intermediate burning positions adjusting the size of the respective openings in the snuffer 42 and thus any flame height. Such control movement of dampers 32, 33 is illustrated by arrows A, B in FIG. 7. The dampers 32, 33 are coupled via a pivotable linkage 62 to the shaft 58 so that upon rotation of the shaft 58 by the control knob 30, an upper edge of the damper shutters moves into or out of engagement with an upper edge 65*a*, 65*b* of a V-shaped diverter 64 of snuffer 42 extending generally parallel to the shaft. (see FIGS. 7, 7A and 13) Similarly, rotation of the control knob and shaft moves a lower edge 32*a*, 33*a* of each damper 32, 33 toward or away from respective flanges 66*a*, 66*b* of flanges 66. In this regard, the damper could be pivoted. Preferably they are slotted to receive pins 67 for motion as described. When the dampers 32, 33 are engaged with the adjacent structure as described, in closed configuration, and fuel burning is thereby extinguished. Alternatively, adjustment of the position of the dampers 32, 33 controls the air flow to the flame for regulating the intensity and height thereof. The dampers 32, 33, diverter 64, flanges 66*a*, 66*b* and related structure combine to form a flue or controller for the burning fuel.

Of course, while specific drawer and motion compartments have been described, and other suitable components could be used, it will be readily appreciated that a preferred embodiment of the invention comprises a fuel tray 36 which can easily be unlatched and drawn forwardly or outwardly of hearth 10 for loading of a gel fuel 34 (to be described) or other suitable fuel.

Thereafter, the drawer 28 and tray 36 are pushed rearwardly into hearth 10 and the tray is lifted by the ending motion of the return to operative engagement with a snuffer 42.

It will be appreciated that the lower flanges 48 of the snuffer are engaged with upper flanges or lips 40 of the tray 36 to effectively seal the chamber 37 so the snuffer 42 is operable to extinguish flame therefrom when dampers 32, 33 are closed.

A projection 35 of knob 30 extends downwardly and blocks outward motion of drawer 28 and tray 36 unless the knob 30 is positioned to close openings 60, 61 in a snuffer 42 with dampers 32, 33 (FIG. 8). Thus, for all operable open or "burn" positions of dampers 32, 33, knob 30 and projection 35 block outward movement of drawer 28. This prevents the opening or withdrawal of fuel tray 36 when any flame is burning.

Shaft 58 is engaged by a double spring clip 59 which frictionally maintains the rotary position of shaft 58 and thus that of linkage 62 and the damper position, once set.

It will be also be appreciated that stationary rails 55*a* and 55*b* are secured to base 12. Rollers 38 are oriented on the rear ends of drawer rails 44, 45 and ride in the stationary rails 55*a* and 55*b*, respectively. Forward rollers are mounted on the stationary rails 55*a* and 55*b* and support the drawer rails 44, 45 so those rails are easily pulled and pushed outwardly and inwardly as described, carrying tray 36. Also, it will be appreciated that tray 36 moves with respect to drawer rails 44, 45 after the tray is stopped by stop 46, in order that it is raised toward snuffer 42.

A strap 53 (FIG. 10B) is disposed to secure stationary rails 55*a*, 55*b* from separating apart.

The roof 20 of the fireplace hearth 10 includes a single piece heat shield 68 (FIGS. 7 and 11) mounted interiorly thereof to deflect hot air generated by the burning fuel from impinging upon the roof 20. This maintains the roof at a lower temperature to avoid someone being burned by touching the roof 20 during operation of the fireplace hearth 10. The heat shield 68 is spaced from the roof 20 to thereby provide an insulation layer of air 70 between the heat shield and the roof 20 and further minimize the transfer of heat to the roof 20. Additionally, around the perimeter of the heat shield 68, a raised baffle 72 is provided which terminates at the corners of the heat shield at slits 74 defined by the space between edges 75 of roof 20 and 76 of heat shield 68 (FIG. 7). A tongue 77 connects the heat shield 68 to the roof 20 at each of the four corners. This structure allows for the hot air from the fire which impinges upon the heat shield to be directed outwardly and downwardly away from the roof 20. Furthermore, the baffles 72 and slits 74 between the roof 20 and the heat shield 68 allow for cooler air to be drawn into and circulate around the roof 20, entering the space between the heat shield and the roof 20 to provide the insulation of air 70 therebetween. Furthermore, air which is warmed in the insulation layer 70 rises and escapes between the cap 22 and the roof 20 and is replaced by cooler air drawn in by slits 74. It will be appreciated that the passage from slits 74 to caps 22 are unobstructed, allowing a free flow of air between roof 20 and shield 68 with the only contact between them at the corners. This helps keep roof 20 from becoming too hot.

Figure 13:
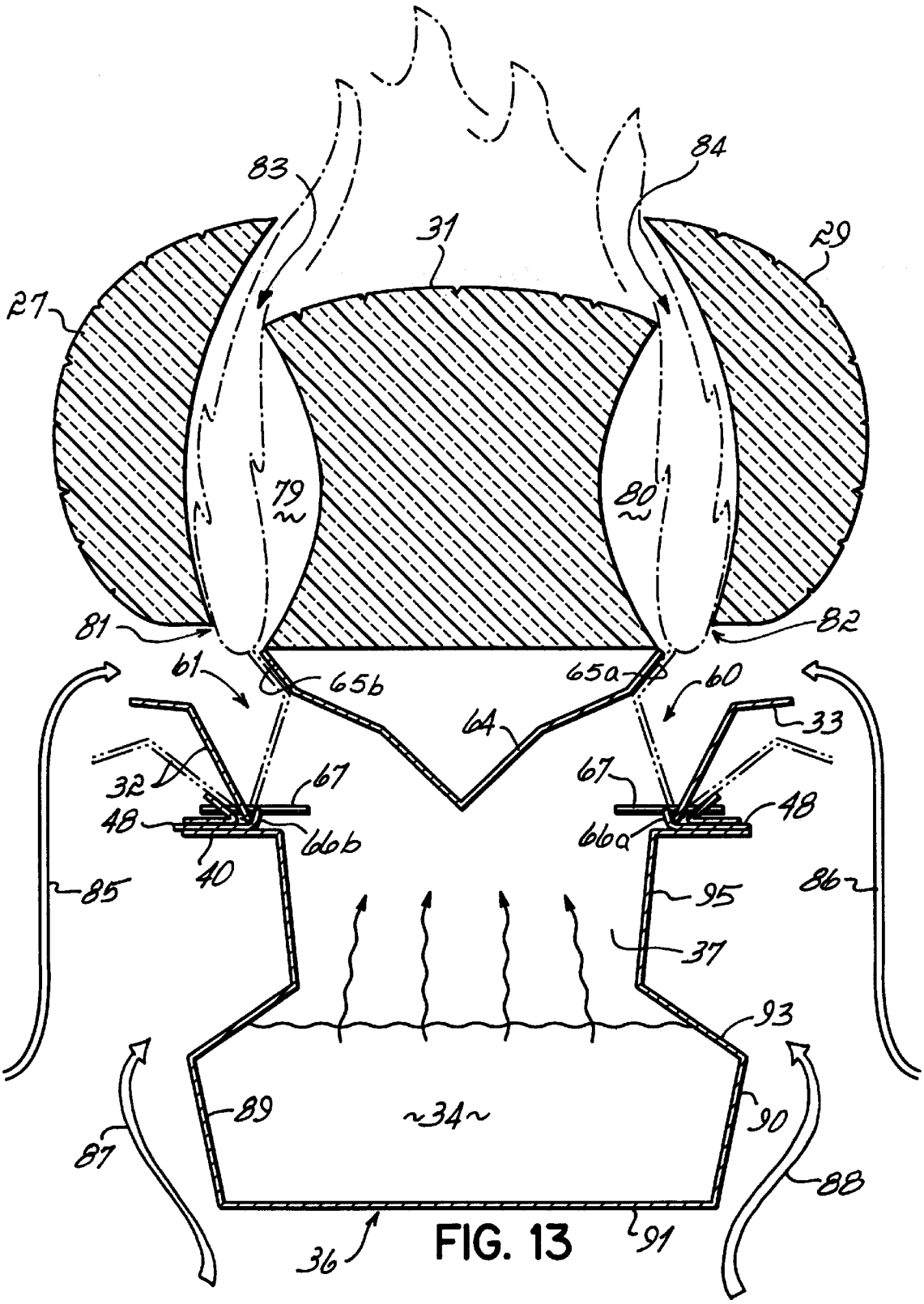
FIG. 13 is a diagrammatic elevational illustration of the combustion systems of the invention of FIG. 1.
Figure 14:
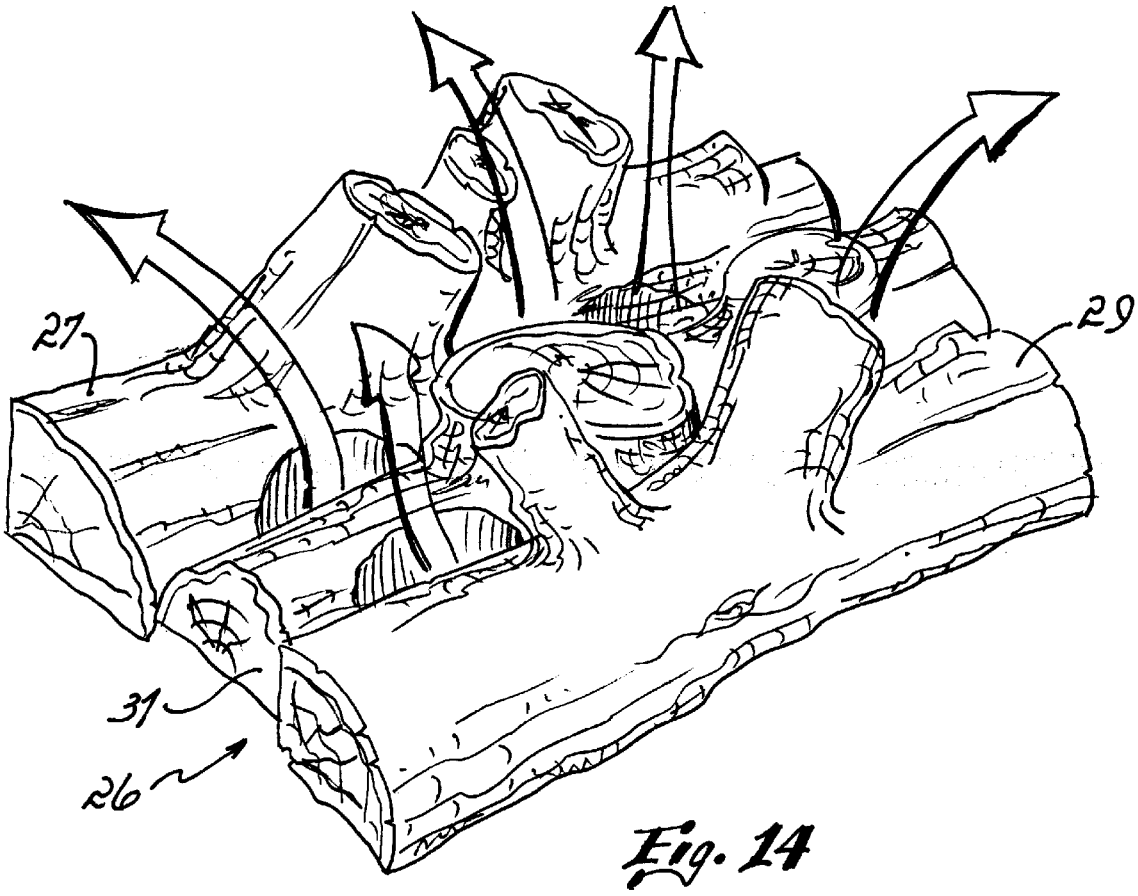
FIG. 14 is a diagrammatic perspective illustrative of a log set used in the hearth of FIG. 1.

Log set 26 is diagrammatically illustrated in FIGS. 1, 13 and 14. It may be made of a fiber and ceramic material or any other suitable material for this use. The log set 26 may be formed in one piece or in a plurality of separate pieces, fitted or joined together to provide the appearance of authentic logs. FIGS. 13 and 14 illustrate side logs 27, 29 and a center log 31, for example, for illustrative purposes only.

However formed, the log set has a plurality of passages. Two of these are illustrated at 79, 80 (FIG. 13). These passages have respective entry ends 81, 82 and outlet ends 83, 84. Entry ends 81, 82 are disposed proximate the openings 60, 61 in snuffer 42 for receiving flames therefrom, the flames extending upwardly through passages 79, 80 to and through outlets 83, 84.

It will also be appreciated that inlets 81, 82 are disposed or oriented such that ambient air can be drawn into the inlets, mixing with the flames, decoupling the flame, and lifting the flame up through the log set 26. Further, it will be appreciated that the outer logs 27, 29 could be lower than the center log 31. In any event, the top edges of dampers 32, 33 form a gap (changing when the dampers are moved) between the dampers and the logs 27, 29 respectively. This gap allows air into inlets 81, 82 to decouple and lift the flames through passages 79, 80.

As the flame moves up passages 79, 80 they heat the surrounding log set material and this heating produces a convection effect, drawing outside air 85, 86 into the passages 79, 80 and into the flames. The amount of heat so generated and the resulting convection effect produced is controlled by the flames which are in turn controlled by the position of dampers 32, 33. The drawing in of decoupling air is thus self-regulating as a function of flame control by the dampers 32, 33, and as a function of the gap between top edges of the dampers and either the logs or any adjacent floor structure.

While only two passages 79, 80 are shown in FIG. 13, there may be numerous passages through the log set 26, such as the passages 1–5 in FIG. 14. As shown, it is desirable that the passages are generally oriented to reduce actual flame contact on the log set material and thereby reduce sooting of the surfaces. The manner of the formation of the log set 26 or of its individual components at this interconnection is not a part of this invention. The passages such as 79, 80 can be formed through the log components or therebetween as desired. Preferably, there is an elongated space between the respective outer or side logs 27, 29 and center log 31. This space (passages 79, 80 for example) are open at the bottom near snuffer 42, but may be bridged at the top by contact of the side logs 27, 29 with the center log.

Having explained and described the structural features and operation of the fireplace hearth according to presently preferred embodiments of this invention, the fuel 34 which is particularly adapted for use in the fireplace hearth comprises an additional aspect of the present invention. Specifically, the fuel for use in the present invention is a gel composition which satisfies the characteristics of fireplace fuel with respect to aesthetic features such as producing a golden high luminous flame without producing an offensive odor or smoke and generating a crackle and pop sound. The fuel is safe for handling and storage purposes and is formulated from generally non-toxic components. The fuel is self-contained if spilled, environmentally safe in burning, producing minimal pollutants and readily extinguishable without any smoke build-up. Further the product does not produce any significant amount of residue.

The gel composition for use in the present invention is a mixture of a lower alkyl alcohol preferably ethanol, water, a flammable organic composition which produces a golden flame, such as an aliphatic hydrocarbon preferably with an aniline point above 180° F. (such as odorless mineral spirits). Tertiary butyl alcohol also produces a yellow flame and stabilizes the gel. The gel composition also includes cross-linked and double-walled microencapsulated solvents such as toluene, xylene, etc. and a gelling agent such as water and a minor amount of polyacrylic acid or polyacrylate, along with a cross-linking agent and a surfactant. This is neutralized to a pH of 6–10 with a basic amine such as triethanolamine, diethanolamine, Ethomine (manufactured by Sonobel) and other organic bases.

The gel formulation has a viscosity of 500,000 cps or higher in a high yield value fuel with excellent suspending properties. The aliphatic hydrocarbons produce the golden yellow flame without producing smoke or soot when burned unlike normal characteristics of aromatic compounds.

A preferred formulation includes:

| Ingredients | Preferred % by Weight | % Range |
|---|---|---|
| Ethanol anhydrous | 58.5 | 50 to 65 |
| proprietary Polyacrylic acid (Carbopol E21 from BF Goodrich) | 0.5 | 0.2–1.2 |
| Water | 28.5 | 25–38 |
| Aliphatic hydrocarbons (odorless mineral spirits) | 6.84 | 2–15 |
| Tertiary Butyl Alcohol | 5.16 | 0–12 |
| Denatonium Benzoate (bittering agent, for safety) | 40 ppm | 40 ppm |
| Triethanolamine | 0.4 | 0.3–1.0 |
| dye | 5 ppm | 2–30 ppm |
| Toluene/Xylene | 0.1 | 0.1–1.0 |
| capsules | 100 | |

The product is formulated by combining the polyacrylic acid with water to wet the polyacrylic acid. The remaining components are added into the mix under agitation. The process is completed by neutralizing the excess acid and further mixing for uniformity of the product by pumping (recirculation) of product through an in-line static mixer.

Preferably the solvent microcapsules are cross-linked and double-walled complexes formed by coacervation. Single walled complexes could be used. The cross linked gelatin double wall forms about 30% of the capsule weight. This prevents permeation of the solvents to provide a long shelf life. Further, the capsules should have a size greater than 500 microns, preferably 600 to 1500 microns with 50% or more of the capsules being 900–1200 microns.

Further the solvent in the microcapsule is an aromatic solvent preferably a lower alkyl aromatic solvent such as toluene or xylene having a vapor pressure of 5 to 15 millimeters mercury at 68° F. and a boiling range of 300–325° F. This produces the best crackling sound during burning.

This formulation is readily soluble in water making it easy to clean without leaving any stain on the carpet or flooring materials. Further the product is made safe to handle.

In an alternative embodiment of the fuel, the tertiary butyl alcohol (TBA) is omitted and the aliphatic hydrocarbon (odorless mineral spirits) is increased to about 12% by weight. This aids in reduction of the flame point temperature of the fuel when that might be desired, but may exhibit a small problem of separation of some of the components.

Turning now to FIGS. 13 and 14, the preferred combustion process provided by the invention produces a flame with a random dancing pattern, of golden color as if burning from wood fuel, a crackling authentic wood burning sound, with minimal use of fuel and over a burn time of about 2–4 hours, depending on the position of dampers 32, 33.

Initially, a load or unit of fuel 34 is introduced to tray 36. An amount of about 64 ounces of fuel 34 is appropriate to fill tray 36, pulled out from base 12, to a level as illustrated in FIG. 13. Thereafter, the drawer 28 and tray 36 are pushed into the hearth 10. The lateral motion of tray 36 is stopped while slides or rails 44, 45 continue rearwardly, as previously described. This cams the tray 6 up into operative engagement with the snuffer 42 and the drawer 28 and tray 36 are latched in this position.

Knob 30 can now be turned to open dampers 32, 33. Vaporization of fuel 34 occurs and the fuel vapor rises from tray 36 up through its throat 39 where it is constricted toward snuffer 42. The vapors are diverted by diverter 64 through openings 60, 61 between the diverter 64 and dampers 32, 33.

When the vapors are lit by a suitable ignitor, flame is produced. This flame appears at the snuffer and rises upwardly toward passages 79, 80. As the log set 26 heats, the heat draws air (85, 86) into the entry ends of the passages 81, 82 between the dampers 32, 33 and the logs or any adjacent floor 13 (not shown) which may be situated just to the side and beneath the logs. This convection air decouples the flame from the snuffer 42 and tray 36 and helps lift the flame upwardly through and above log set 26.

At the same time, air 87, 88 is drawn or convected upwardly around tray 36, cooling the tray and keeping fuel from becoming too hot and thus regulating its vaporization.

Dampers 32, 33 can be moved through manipulation of knob 30, turning shaft 58 and moving linkage 62 through various burn positions regulating the flame produced. Movement of dampers 32, 33 to restrict openings 60, 61 reduces the flame height and movement of dampers 32, 33 to enlarge openings 60, 61, permitting passage of more fuel vapor, enlarging the flames and opening the side passages between dampers and logs on floors for more decoupling air.

For all positions of knob 30 wherein dampers 32, 33 are open, knob projection 35 restricts outward lateral motion of tray 36 and drawer 28 so that it cannot be extended out of hearth 10 while fuel is burning. When knob 30 is turned to move dampers 32, 33 to close off openings 60, 61 and snuff out any flame, projection 35 is moved away from its tray and drawer blocking position. This allows refueling.

When the dampers 32, 33 are moved to fully open openings 60, 61, maximum flame height and a shorter burn time of about two hours results. When dampers 32, 33 are moved to restrict openings 60, 61 to the lowest suitable flame, an extended burn time of about four hours is provided by the 64 ounce fuel unit.

This combustion system thus operates like a carbureation system, wherein the fuel vapors are concentrated by throat 39, throttled at dampers 32, 33 and then boosted, in flame, by the decoupling air.

While not restricted to any particular sizes, one combination of sizes of various components found suitable is as follows. Of course, these dimensions are approximations for purposes of clarity of description and may be varied in production.

Fuel tray 36 is about 12 inches long measured between two tray end panels about 4⅝ inches wide at its bottom. Sides 89, 90 of tray 36 extend up from bottom 91 and outwardly at an angle from the horizontal of about 100 degrees, for about 1½ inch. Throat panels 92, 93 then taper inwardly from upper edges of side 89, 90 for about 1 inch at an angle of about 35 degrees from the horizontal. From the inner edges of throat panels 92, 93, the throat panels 94, 95 extend upwardly and outwardly for about 1½ inches at an angle of about 5 degrees from the vertical to the tray lip or flange 40. Overall vertical height of the tray 36 from bottom 91 to flanges 40 is about 3½ inches. The throat 39 at the top of the panels 92, 93 is a little over 3 inches wide. When filled with a preferred unit of fuel 34, the filled fuel level is just below the junction of panels 89, 90 with throat panels 92, 93 respectively.

The snuffer 42, at its opening to tray 36 through throat 39 is about 12 inches long and that snuffer opening is preferably slightly larger than the upper opening of the throat 39 between the upper edges of panels 94, 95. The openings 60, 61 in snuffer 42 are about 12 inches long and a little over one inch wide, resulting in a cross-sectional area of about 13 square inches for each opening 60, 61.

As noted, there are preferably numerous passages, such as passages 79, 80 up through log set 26. Fire passages 1–5 are shown in FIG. 14. These passages are positioned in the log set to give the aesthetic appearance of an authentic wood fire by means of bridges over the logs. At the bottom of the passages 1–5 (i.e. such as 78, 80) the entry openings 81, 82 defining a restrictive log out-take (81, 82) are about 12 inches long and about ½ inches wide. The logs themselves are about 16 inches long. Thus, the restrictive log take out flow area is about 6 square inches on each side (FIG. 13). The air gap associated with these openings 81, 82 is formed by the dampers 32, 33 at their top edges and the logs or adjacent floor panels 13. This gap is between about ¼ inches and ⅝ inches so that the effective decoupling air openings are about 12 inches long and vary from ¼ to ⅝ inches wide.

These dimensions result in a combustion system which is self-regulating when the dampers are moved for the best efficiency for all burn positions. Of course, other dimensions, shapes and sizes of all components will be appreciated. Variations in the parameters of one combustion system component will or may vary the parameter of another component.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A fireplace hearth apparatus for producing a flame and comprising:

a snuffer;

a fuel tray oriented operably beneath said snuffer;

said fuel tray being movably mounted to said apparatus for downward and lateral movement away from said snuffer for filling and said fuel tray being laterally and upwardly movable under said snuffer for operative engagement with said snuffer.

2. The apparatus as in claim 1 wherein said fuel tray is mounted for movement downwardly and away from said snuffer when said tray is moved laterally from beneath said snuffer.

3. The apparatus as in claim 2 wherein said snuffer comprises at least one damper for closing off flame burning from fuel in said fuel tray.

4. The apparatus as in claim 3 wherein said snuffer includes two elongated openings disposed generally vertically and a movable damper disposed at each opening for adjustably covering or opening said openings.

5. The apparatus as in claim 4 wherein said dampers are mounted for simultaneous movement selectively toward and away from the respective openings.

6. The apparatus as in claim 3 wherein said snuffer includes a lower opening and said fuel tray includes an upper opening, said two openings being operably juxtaposed together when said fuel tray is disposed under and moved upwardly into engagement with said snuffer.

7. The apparatus as in claim 1 wherein said tray is mounted on elongated first rails secured to said hearth for lateral movement with respect to said hearth and further including tray rails on each side of said tray, a first cam member on said tray rails and a second cooperating cam member on said fuel tray in operative relation with said tray rails, such that said fuel tray is lifted and lowered as it moves respectively into engagement with and under said snuffer and out of engagement and laterally away from said snuffer.

8. The apparatus as in claim 7 wherein said first cam member is a cam slot and said second cam member on said fuel tray is a cam follower.

9. The apparatus as in claim 1 including a releasable latch for holding said tray in operative engagement with said snuffer.

10. The apparatus as in claim 1 further including an adjustable damper element operably disposed with respect to said snuffer for controlling said flame, a knob mounted on said apparatus for adjusting said damper element between a flame shut-off position and a plurality of flame burning positions, and said knob having a projecting portion which is positioned to block lateral movement of said fuel tray from beneath said snuffer for all flame burning positions of said damper element.

11. A fireplace hearth including a roof disposed over a fire area, said roof comprising:

an upper roof panel;

a heat shield under said roof panel;

said heat shield defining an air flow space between said roof panel and said heat shield;

elongated openings defined by adjacent edges of said roof panel and said heat shield for ingress of ambient air;

a vent disposed in said roof panel; and the space between said heat shield and said roof panel being unobstructed, such that air freely flows from said elongated edges to said vent without obstruction in said flow, and wherein said roof panel has a plurality of corners and said heat shield is connected to said roof panel only at said corners.

12. The hearth as in claim 11 wherein said heat shield is a one-piece heat shield.

13. A freestanding fireplace hearth having a bottom, a plurality of sides, a roof, a snuffer and a movable fuel tray mounted operably beneath said snuffer and being movable laterally for fueling, said tray movable upwardly for sealing engagement with said snuffer when disposed thereunder and movable downwardly away from said snuffer when pulled laterally for refueling, said hearth further having a plurality of posts defining corners, each post having an elongated slot therein for receiving and holding an edge of a glass side of said hearth, and said elongated slot having an elongated groove therein for receiving a tenon of a structural side member therein above said glass side.

14. The hearth as in claim 13 further including a roof panel and a roof-mounted heat shield mounted to said roof, and further including mounting projections on said heat shield, said projections being receivable in open ends of said posts.

15. A free-standing fireplace hearth for burning a fuel to provide ambiance fire, the system comprising:

a base having a drawer slidably mounted therein for movement between open and closed configurations;

a spring biased latch to releasably secure the drawer in the closed configuration;

a tray moveably mounted in the drawer and adapted to receive therein the fuel, the tray being mounted for movement between a lowered and a raised position;

tray lifting means operatively coupled between said tray and said drawer for lifting said tray with respect to said drawer when said drawer is moved toward a closed position;

a stop mounted on the base relative to the drawer and the tray so that as the drawer approaches the closed configuration the tray abuts against the stop and continued movement of the drawer toward the closed configuration elevates the tray relative to the drawer into the raised position and sealing contact with a flue;

a pair of spaced damper shutters mounted for movement between a closed snuffing configuration and a fully open configuration in said flue, each of the damper shutters being coupled via a linkage to a rotational control knob such that rotation of the control knob in a first direction pivots the damper shutters toward the closed snuffing configuration in the flue to extinguish the burning fuel and rotation of the control knob in a second direction pivots the damper shutters toward the fully open configuration to allow increasing amounts of vaporized fuel to rise in said flue for burning;

a plurality of posts extending upwardly from the base;

a cover supported by the posts;

a heat shield mounted interiorly of the cover to deflect hot air generated by the burning fuel from impinging upon the cover and maintain the cover at a lower temperature than the heat shield during fuel burning, at least a portion of the heat shield being spaced from the cover to permit an insulation layer of air between the heat shield and the cover; and a plurality of baffles in the heat shield to direct the hot air from the heat shield and cooler air into the insulation layer of air between the cover and the heat shield.

16. A fireplace hearth comprising:

a laterally movable fuel tray defining a volatile fuel chamber, a constricting throat in said fuel tray above said chamber;

a snuffer;

said tray being operably oriented beneath said snuffer;

a wedge-shaped diverter in an upper portion of said snuffer and defining two openings;

an adjustable damper movable toward and away from each said opening to adjust the size of said openings in a plurality of flame burning positions and to close off each respective opening;

a log set disposed above said snuffer, said log set having a plurality of flame passages therethrough for receiving flame from openings in said snuffer and for receiving air from outside said snuffer, said air mixing with and lifting said flame through said log set.

17. The hearth as in claim 16 wherein said log set, when heated by said flame, causes convection of air through said flame passages.

18. The hearth as in claim 17 wherein said dampers are movable to reduce the size of said openings and thereby the flame and amount of heat produced by said flame, said dampers thereby reducing the flow of convection air through said log set.

19. The hearth as in claim 16 wherein said tray is movable downwardly and laterally out from under said snuffer for filling with fuel, and then laterally under and operably upwardly toward said snuffer for burning of said fuel.

* * * * *